United States Patent [19]

Nesbitt

[11] 4,191,357

[45] Mar. 4, 1980

[54] DUPLICATOR FOR BOWLING BALL FINGER AND THUMB HOLES

[76] Inventor: James G. Nesbitt, 431 Duncan Ave., Stockton, Calif. 95207

[21] Appl. No.: 922,667

[22] Filed: Jul. 7, 1978

[51] Int. Cl.[2] ..... E04G 17/00

[52] U.S. Cl. ..... 249/205; 33/174 F; 249/83; 249/177; 249/219 R; 425/90; 425/383; 269/296

[58] Field of Search ..... 425/90, 383; 273/63; 33/174 F; 269/1, 296; 249/205, 83, 177, 219 R

[56] References Cited

U.S. PATENT DOCUMENTS

| | | | |
|---|---|---|---|
| 2,706,338 | 4/1955 | Ackerman et al. | 33/174 |
| 2,840,011 | 6/1958 | Rasmusson | 249/205 |
| 3,225,448 | 12/1965 | Dorey | 33/174 |
| 3,255,992 | 6/1966 | Kersten | 249/205 |
| 3,273,250 | 9/1966 | Egger | 33/174 |
| 3,316,588 | 5/1967 | Vezirakis | 425/110 |
| 3,411,742 | 11/1968 | McArdle | 249/205 |
| 3,503,584 | 3/1970 | Erhart et al. | 249/205 |
| 3,858,839 | 1/1975 | Bowman | 249/83 |
| 4,044,985 | 8/1977 | Ghang | 249/205 |

*Primary Examiner*—William E. Schulz
*Attorney, Agent, or Firm*—Roger B. Webster

[57] ABSTRACT

An apparatus, and method, for producing finger and thumb holes in one bowling ball which are identic to those existing in another bowling ball; the essential purpose being to duplicate—in a new bowling ball, for example—the exact size, shape, direction, and span of the finger and thumb holes in an existing, properly hand-fitting, bowling ball.

9 Claims, 5 Drawing Figures

FIG-1
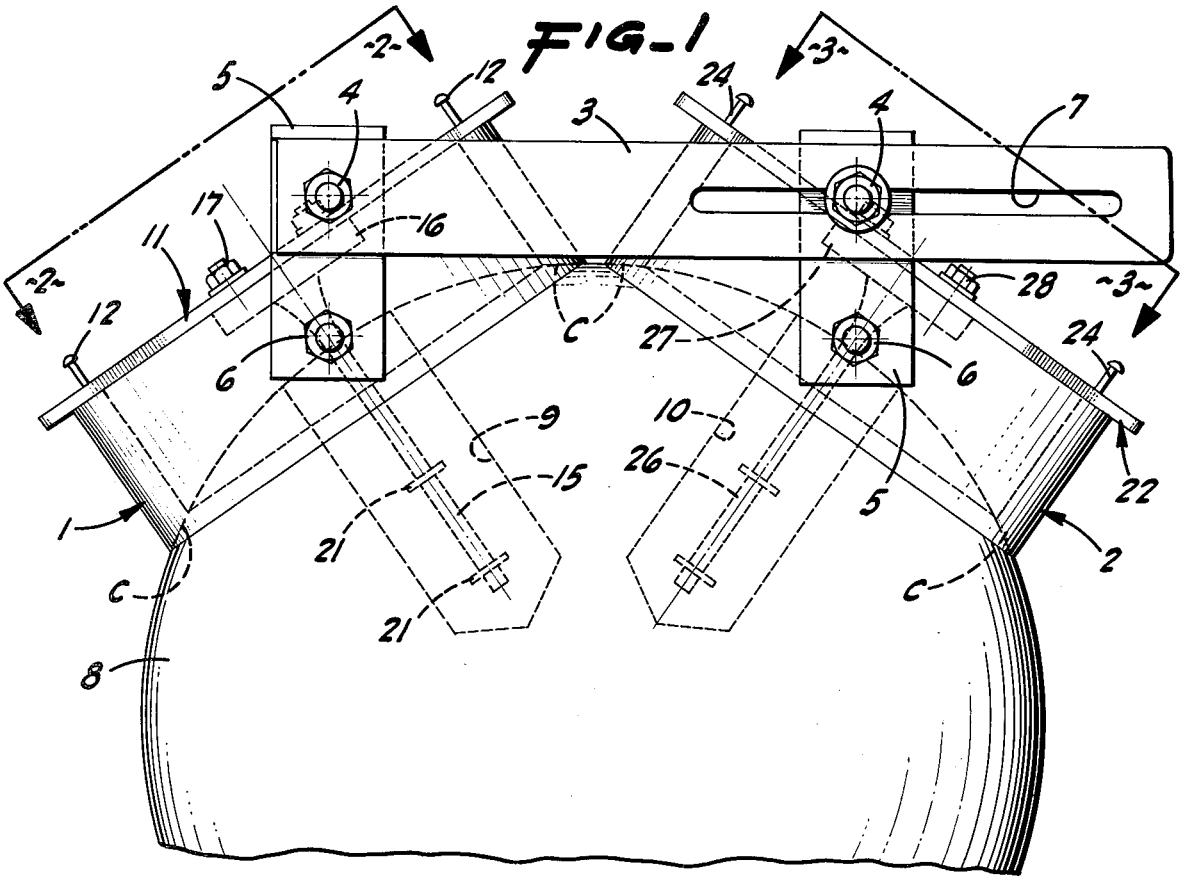
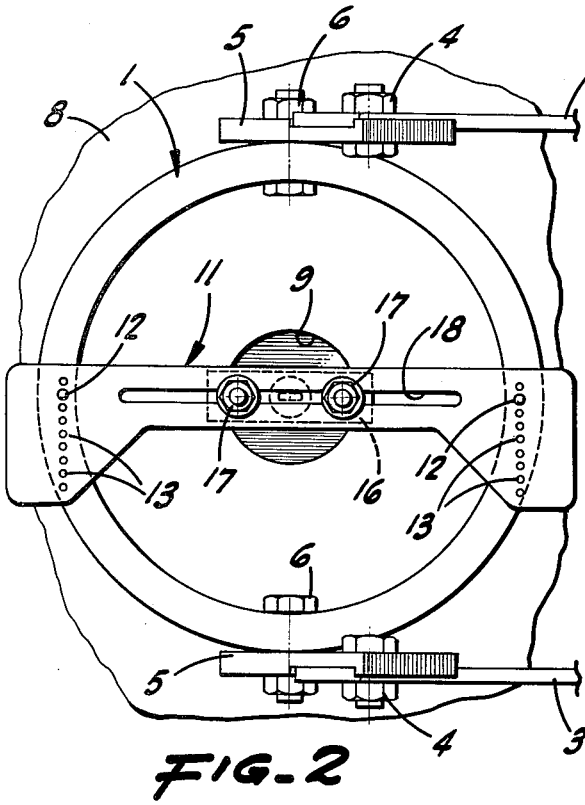
FIG-2
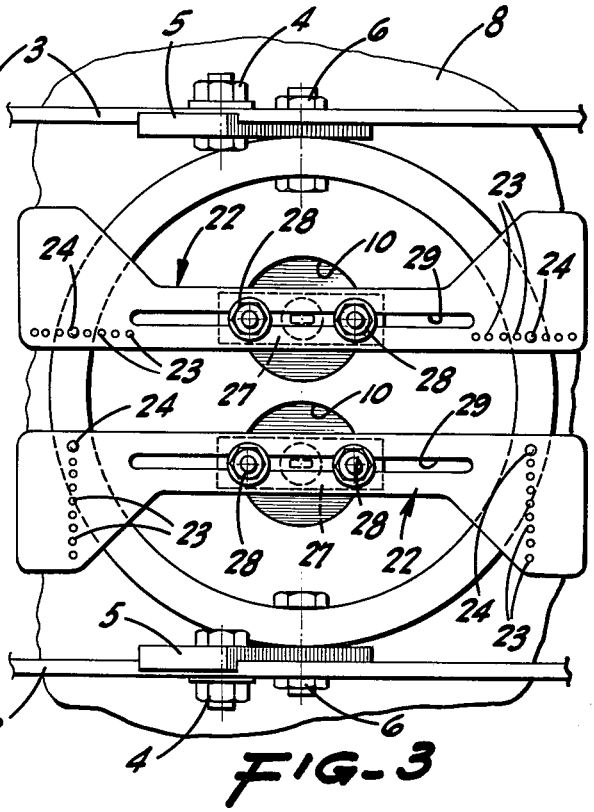
FIG-3

DUPLICATOR FOR BOWLING BALL FINGER AND THUMB HOLES

BACKGROUND OF THE INVENTION

1. Field of the Invention

While various apparatuses, and methods, are known for the purpose of producing custom fitted finger and thumb holes in bowling balls, efforts to accurately duplicate the finger and thumb holes existing in one ball in another ball (as, for example, by measured, controlled drilling) have not met with any substantial acceptance. The present invention was conceived in a successful effort to accomplish such duplication.

2. The Prior Art

U.S. Pat. Nos. 2,712,160; 2,843,382; 3,386,176; 3,454,440 and 3,858,839 represent the most relevant prior art known to applicant.

The above prior art—considered singly or together—does not anticipate, nor suggest as obvious, the particular structure of the herein-claimed duplicator for bowling ball finger and thumb holes, and applicant has no knowledge of any prior art disclosing such particular structure.

SUMMARY OF THE INVENTION

The present invention provides, as a major object, an apparatus, and method, for producing finger and thumb holes in one bowling ball (as, for example, in a new undrilled ball) which are identic to the finger and thumb holes existing in another bowling ball (as, for example, a used ball).

The present invention provides, as another important object, an apparatus, and method, as above, whose essential purpose is to duplicate in a new bowling ball the exact size, shape, direction, and span of the finger and thumb holes in an existing, used bowling ball. In this manner, a bowler—once one bowling ball is drilled with properly fitting finger and thumb holes—can readily obtain another bowling ball with matching finger and thumb holes.

The present invention provides, as a further object, a duplicator for bowling ball finger and thumb holes which is designed for ease and economy of manufacture.

The present invention provides, as a still further object, a practical and reliable duplicator for bowling ball finger and thumb holes, and one which is exceedingly effective for the purpose for which it is designed.

BRIEF DESCRIPTION OF THE DRAWINGS

FIG. 1 is an elevation of the apparatus as positioned on a used bowling ball preparatory to producing castings of the finger and thumb holes.

FIG. 2 is a fragmentary plan view; the view being taken substantially on line 2—2 of FIG. 1.

FIG. 3 is a fragmentary plan view; the view being taken substantially on line 3—3 of FIG. 1.

DESCRIPTION OF THE PREFERRED EMBODIMENT

Figure 4:
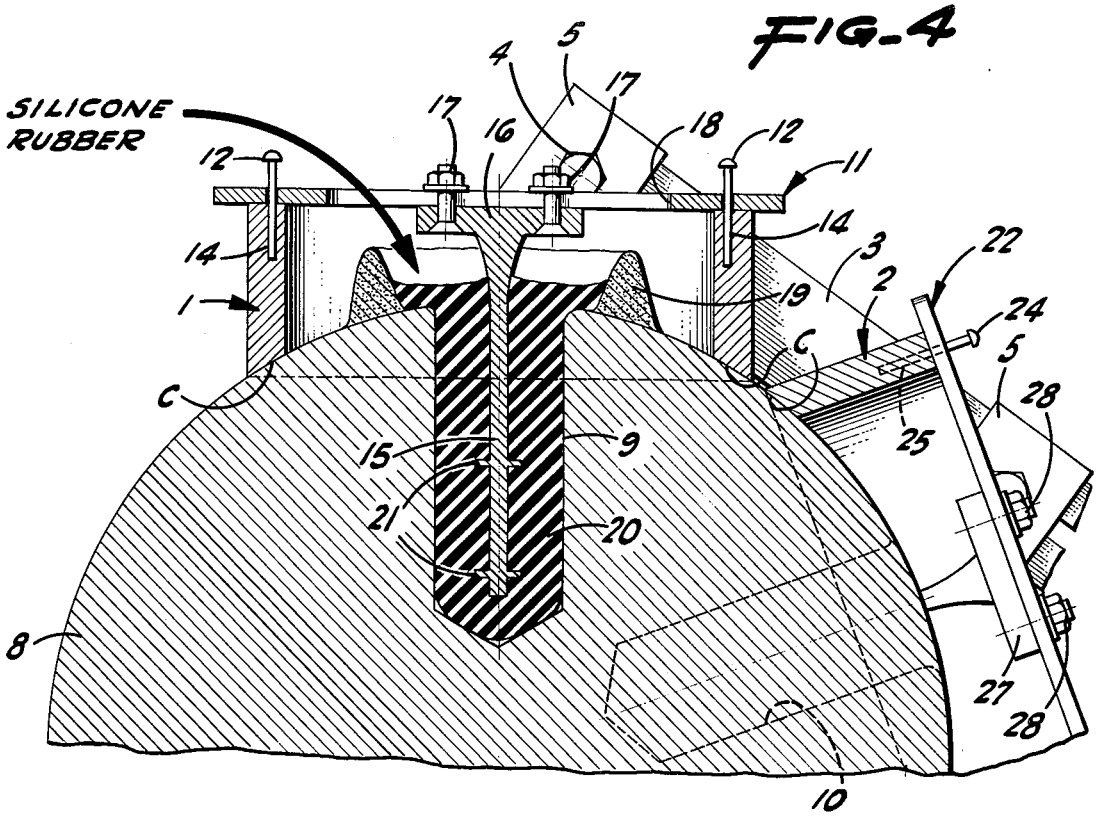
FIG. 4 is a fragmentary elevation of the apparatus, partly in section, as positioned in FIG. 1, but shows the casting as produced in one of the holes in a used bowling ball.

Referring now more particularly to the drawings and to the characters of reference marked thereon, the apparatus comprises adjacent but spaced rings 1 and 2 of substantial diameter and relatively wide axially; such rings being interconnected on opposite sides by parallel tie bars 3 bolted, as at 4, to, and slot-engaged with, the upper ends of ears 5 which—in turn—are bolted adjacent their lower ends, as at 6, to the corresponding rings. The tie bars 3 are longitudinally slotted, as at 7, for reception therethrough of the bolts 4 related to the ring 2; such slotting being provided for the purpose of adjustment of the spacing of the rings 1 and 2. Also, the bolts 6 permit the rings 1 and 2 to be adjusted in their angular relation to each other.

The rings 1 and 2—after appropriate adjustment of spacing and angularity—are seated on the used bowling ball 8 with the ring 1 symmetrically surrounding the thumb hole 9 and the ring 2 symmetrically surrounding the finger holes 10. The rings are chamfered on the lower edge for matching engagement with the surface of the ball, as shown at C.

A longitudinal spanner plate 11 extends generally diametrically across and rests on the ring 1 and is located thereon by pins 12 which are engaged through selected holes in rows 13 thereof in the end portions of spanner plate 11; such rows 13 of holes being parallel to each other and extend substantially tangent to the corresponding sides of ring 1, with the pins 12 engaging in holes 14 in the upper edge portion of said ring at diametrically opposed points.

A core rod 15 depends into the thumb hole 9 from the spanner plate 11; such core rod having a head 16 which abuts the spanner plate 11 from beneath and is longitudinally adjustably secured thereto by bolts 17 which extend through a longitudinal slot 18. By appropriately adjusting the spanner plate 11 on ring 1, and adjusting the head 16 on said spanner plate, the core rod 15 is set to depend substantially centrally into the thumb hole 9. See FIG. 4.

Upon the core rod 15 being so disposed, and after an annular clay dam 19 is formed about said thumb hole 9 as an overflow "stop", a fluid—but fast-hardening—silicone rubber compound is poured into said thumb hole 9 whereby there is formed, on core rod 15, a casting 20 having the configuration of such thumb hole. The core rod 15 includes projections 21 which assure against escape of casting 20 from such rod.

Castings (not shown) are then made of both of the finger holes 10, and this is accomplished in substantially the same manner and by like instrumentalities as described above relative to the formation of casting 20.

More particularly, a pair of side-by-side but spaced, parallel spanner plates 22 rest on the ring 2, and at their ends such spanner plates 22 include rows 23 of holes through selected ones of which pins 24 extend and thence engage in pin holes 25 in said ring 2, whereby the spanner plates 22 are adjusted to lie directly above the corresponding finger holes 10. To permit of more universal adjustment of spanner plates 22, the rows 23 of holes in one plate extend lengthwise thereof, while the rows 23 in the other plate extend transversely.

A core rod 26 depends from each spanner plate 22 substantially centrally into the corresponding finger hole 10, and each such core rod 26 includes a head 27 adjustably secured to the related spanner plate 22 by bolts 28 which pass through a longitudinal slot 29 in such spanner plate.

Thus, with the core rods 26 depending into the finger holes 10, silicone rubber castings of said finger holes are formed on the core rods 26 in the same fashion that the casting 20 is formed on core rod 15.

After the three castings have been formed (a thumb hole casting on core rod 15 and a finger hole casting on each core rod 26), the entire apparatus is removed from the used bowling ball 8, and at which time the castings pull free from the latter. The castings, however, remain in the exact positional relation to each other as existed when formed in the used bowling ball; this by reason of the rigid supporting structure provided for the respective core rods.

Nextly, the apparatus is manually disposed in a position overlying the new bowling ball 30, and the end positions of the three castings are marked on the face of such new ball. At each such marking, a bore is drilled and with an inside diameter substantially greater than the outside diameter of the corresponding casting. For example, and here by reference to FIG. 5, the oversize bore corresponding to the casting 20 is indicated at 31.

After the three oversize bores are drilled, the apparatus is placed on the new ball 30 with the three castings projecting into the related oversize bores in substantially centered relation; i.e., with spacing from the walls of such oversize bores; the rings 1 and 2 then seating on the new ball 30 just as when seated on the used ball 8 for the purpose of producing the three castings.

Figure 5:
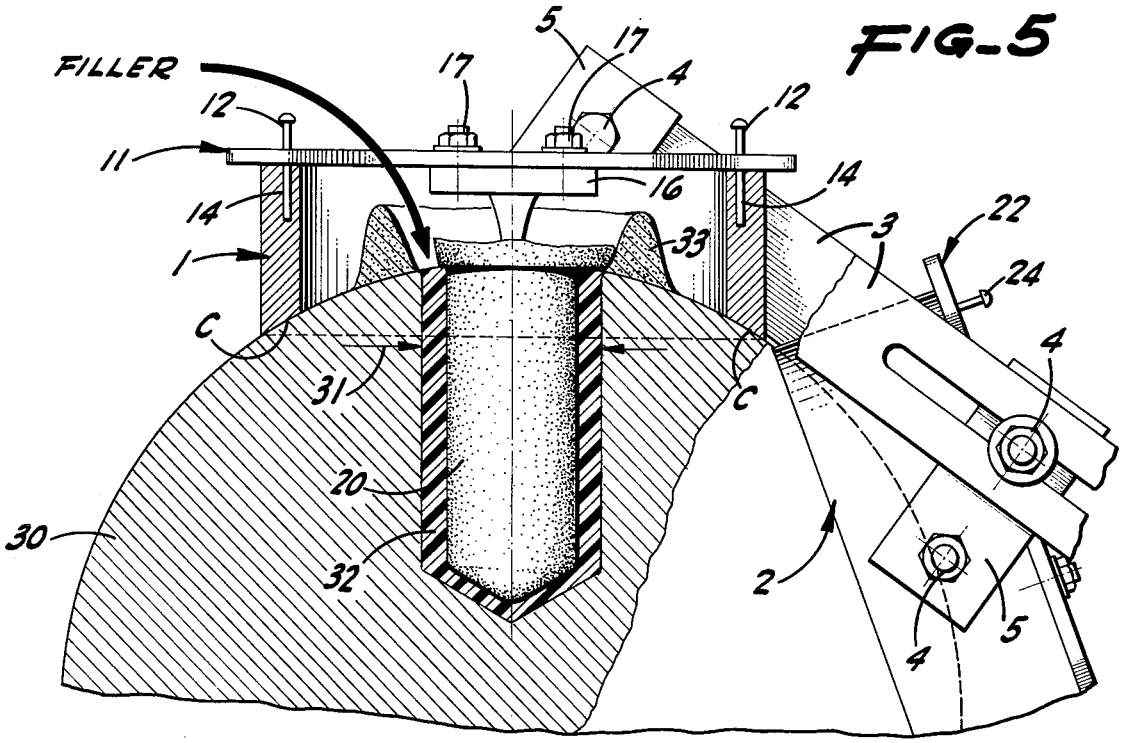
FIG. 5 is a fragmentary elevation of the apparatus, partly in section, as positioned on a new bowling ball; the view showing the hole as produced in such a new ball in matching relation to the corresponding hole in the used bowling ball.

Thereafter, and here by reference to FIG. 5 as an example, a liquid, fast-hardening, epoxy compound—known to the trade as "ball plug" and which is normally employed to totally fill holes on bowling balls for complete re-drilling—is poured into the oversize bore 31 in the space between the thumb hole casting 20 and the oversize bore wall as a filler 32. Any overflow is contained within a clay dam 33 on the new ball about the outer end of each oversize bore. The procedure described immediately above is repeated for each of the oversize bores for the finger holes.

After the filler is introduced, as above, into both the oversize finger and thumb holes in the new ball 30 and such filler hardens in each such hole, the apparatus is wholly removed from such ball, including withdrawal of the three castings; there then remaining in the new ball—and as defined by such fillers—finger and thumb holes which are identic to those which existed in the used ball 8. Thereafter, and preparatory to use of the new ball 30, the clay dam 33 is, of course, removed and the ball ground and surface-polished to remove any excess filler which may exist on the ball surface about the mouths of the finger and thumb holes.

If desired, the rows of holes, as indicated at 13 and 23, and the slots 18 and 29, together with the tie bar slots 7, may have appropriate index markings (such as corresponding numerals or letters) associated therewith so that a record of the settings of the parts of the apparatus may be recorded and later used to re-set said apparatus to again—in still another bowling ball—duplicate the finger and thumb holes of the used ball which provided the initial castings and which—of necessity in such case—be preserved on their core rods for such later use.

Thus, by a relatively simple apparatus and method of its use, it is possible to readily and exactly duplicate in one bowling ball the finger and thumb holes of another bowling ball.

From the foregoing description, it will be readily seen that there has been produced such a duplicator for bowling ball finger and thumb holes as substantially fulfills the objects of the invention as set forth herein.

While this specification sets forth in detail the present and preferred construction of the duplicator for bowling ball finger and thumb holes, still in practice such deviations from such detail may be resorted to as do not form a departure from the spirit of the invention as defined by the appended claims.

I claim:

1. An apparatus for supporting a core rod to be used in duplicating at least one of the finger and thumb holes of one bowling ball in another bowling ball; comprising a member adapted to rest on and be supported by said one bowling ball adjacent such one hole, an element mounted on the member and overlying said hole, and securing means adapted to support the rod on the element and position said rod to depend into such hole in clearance relation to the sides thereof so that a casting of the hole may then be formed on said or rod.

2. An apparatus, as in claim 1, including means laterally adjustably securing the core rod to the element.

3. An apparatus, as in claim 1, in which the member is a ring adapted to rest on said one bowling ball in surrounding relation to such hole.

4. An apparatus, as in claim 3, in which the lower edge of the ring is chamfered for matching engagement with the surface of the ball.

5. An apparatus, as in claim 1, in which the core rod includes laterally projecting casting retention projections.

6. An apparatus, as in claim 1, including two of said members adapted to rest on and be supported by said one bowling ball, the members being rings, one ring being adapted to surround the finger holes and the other ring adapted to surround the thumb hole, means connecting the rings in fixed relation, there being elements mounted on both the rings and overlying the corresponding holes in said one bowling ball, and core rods corresponding and secured to each element and positioned to depend into related holes in clearance relation to the sides thereof and so that a casting of such holes may then be formed on the core rods.

7. An apparatus, as in claim 6, in which the means connecting the rings includes tie bars spanning between and attached to the rings on opposite sides thereof.

8. An apparatus, as in claim 6, in which the elements are spanner plates which bear on the rings from above, with means attaching the spanner plates to the rings; there being side-by-side spanner plates on the ring surrounding the finger holes, and one spanner plate on the ring surrounding the thumb hole.

9. An apparatus, as in claim 8, in which the spanner plate attaching means provides for selective and independent lateral adjustment of said spanner plates; the core rods being individually adjustable lengthwise of the related spanner plate.

* * * * *